United States Patent [19]

Rawlinson, Jr.

[11] 4,185,382

[45] Jan. 29, 1980

[54] CHAIN SAW GAUGING ATTACHMENT

[76] Inventor: John P. Rawlinson, Jr., 300 Booth St., Stratford, Conn. 06497

[21] Appl. No.: 943,532

[22] Filed: Sep. 18, 1978

[51] Int. Cl.[2] ..... B27B 17/02

[52] U.S. Cl. ..... 30/383

[58] Field of Search ..... 30/371, 372, 373, 381, 30/382, 383, 233, 166 R, 122

[56] References Cited

U.S. PATENT DOCUMENTS

| | | | |
|---|---|---|---|
| 946,414 | 1/1910 | Wikander | 30/233 X |
| 2,800,933 | 7/1957 | Michael | 30/373 |
| 2,807,292 | 9/1957 | Gelinas | 30/383 |
| 3,276,490 | 10/1966 | Johansson | 30/383 X |
| 3,364,580 | 1/1968 | Lucia | 30/383 X |
| 3,465,796 | 9/1969 | Schwankl | 30/381 |

*Primary Examiner*—Jimmy C. Peters

*Attorney, Agent, or Firm*—H. Gibner Lehmann; K. Gibner Lehmann

[57] ABSTRACT

A chain saw gauging attachment comprising an elongate, slender gauge rod having at one end a fitting with a bore adapted to receive said end, and means for firmly attaching the rod to the fitting. The fitting has a threaded bore aligned with the first bore and adapted to be threaded onto the protruding portion of an existing stud of the chain saw frame, so as to extend laterally from the latter and from the chain track. As thus mounted, the gauge rod extends along the length of a work piece or log which is to be cut, and the free end of the gauge rod enables the user to fix by sight the place on the log where the next cut is to be made. A knurled periphery of the fitting facilitates its being screwed onto the existing threaded stud. The gauge rod is slender and resilient, whereby it springs back to its original shape if accidentially flexed. The rod can be cut to a desired length, and can have a bend at its free end to facilitate the designating of the place for the next saw cut.

6 Claims, 6 Drawing Figures

Fig. 4
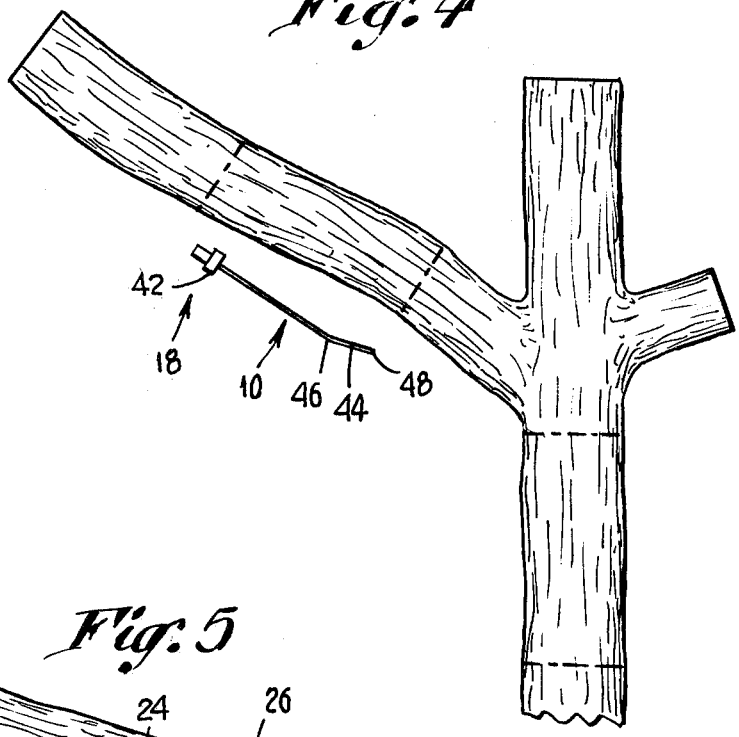
Fig. 5
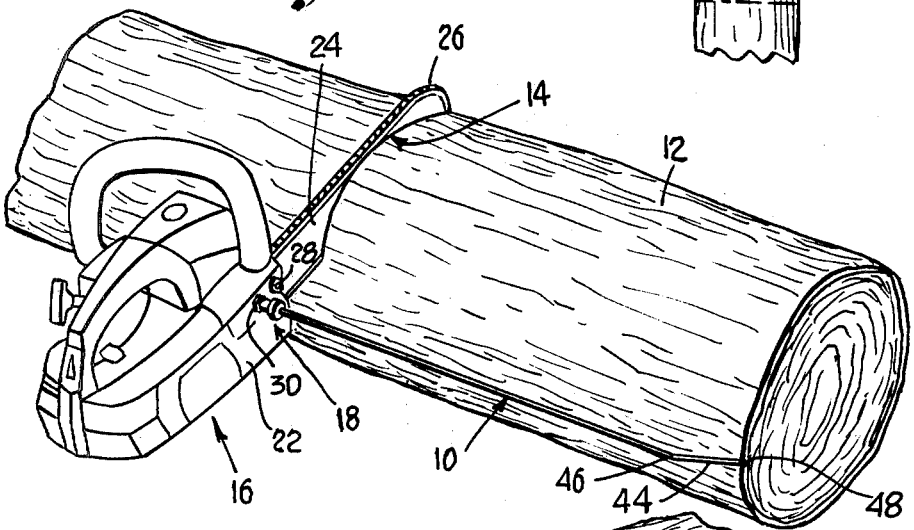
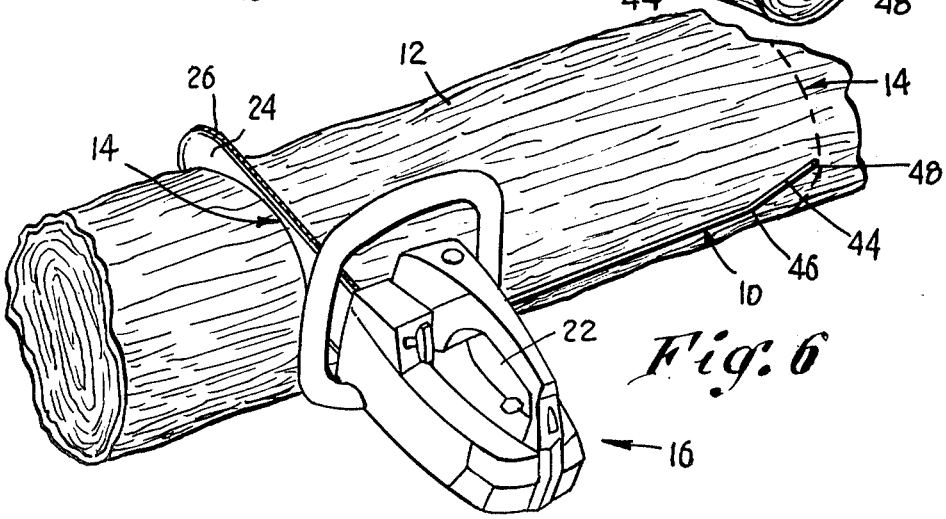
Fig. 6

CHAIN SAW GAUGING ATTACHMENT

BACKGROUND

This invention relates to guiding or gauging attachments for chain saws, and more particularly to attachments of this type, which are intended to facilitate the cutting of logs, branches etc. into uniform lengths.

In the past, various kinds of gauging attachments for chain saws have been proposed and produced, to enable the user to gauge and cut logs into desired uniform lengths. One such attachment has consisted of a mortising gauge bar which extends from opposite sides of an arcuate protractor plate that was adjustable along the chain bar of the saw, whereby the angularity of a cut could be predetermined by setting of the gauge. No provision was made to enable the gauge bar to be extended or shortened so as to predetermine the lengths of the cut-off log sections. Thus, the use of the attachment was restricted solely to determining the angularity of a cut, and no additional functions were possible.

In another prior device a spirally wound scale or ruler tape having a hook at its end, was adapted to be attached to the frame of the chain saw, whereby the flexible tape could be pulled out and hooked onto the end of a log, or limb, enabling the user to position the saw at different distances as indicated by the reading of the tape. This device made it necessary to reset or hook the measuring tape each time that a new cut was to be made. Thus, the rate of the working was considerably slowed. Also, the device was not convenient to use if the saw was in an awkward situation, as when cutting the limbs of a standing tree for instance.

In still other prior proposals, a folding-ruler type gauging device was attached to the chain saw, or alternatively a telescoping-gauge was used, that could be extensible and retractable. In each of these instances, the guage was mounted on an L-shaped swivel arm, and the entire attachment involved numerous parts and a somewhat complicated assembly and disassembly. Not only was the higher cost a considerable factor, but also there existed the likelihood of damager to either the telescoping elements or else the folding ruler sections.

SUMMARY

The above disadvantages and drawbacks of these prior gauging attachments for chain saws are obviated by the present invention, which has for an object the provision of a novel and improved, length-of-cut gauging attachment for chain saws, which is particularly simple in its construction, involving the least number of parts whereby the fabricating cost is brought down to an absolute minimum.

Another object of the invention is to provide an improved gauging attachment for chain saws as above characterized, which can be very easily and quickly set in place or else removed from the chain saw, all without the use of tools, and also at any time that this may be desired.

Still another object of the invention is to provide an improved gauging attachment for chain saws in accordance with the foregoing, which can be easily adjusted to produce the desired length of cut by a simple trimming or snipping operation of the gauge rod or element.

A feature of the invention resides in the provision of an improved chain saw gauging attachment as above set forth, which is damage-resistant to the maximum possible extent whereby it will withstand adverse conditions of use, such as impingement on lateral branches, twigs, etc. during the manuvering of the saw.

Another feature of the invention resides in the provision of an improved chain saw attachment as characterized, which utilizes an existing threaded stud that is provided on the saw to secure the chain bar, whereby the attachment can be readily accomodated to different thread sizes by use of different threaded mounting fittings.

Yet another feature of the invention resides in the provision of an improved chain saw gauging attachment in accordance with the foregoing, characterized by a slender resilient gauge rod that can still be readily, manually bent or formed so as to provide a desired gauge-aiding configuration.

A still further important object of the invention is to provide an improved gauging attachment for chain saws as characterized, which can be readily mounted at a location to the rear of the cutting zone of the saw, and can function in a manner which will not interfere with the cut that is being made.

Still other features and advantages will hereinafter appear.

In accomplishing the foregoing objects, the invention provides an elongate, slender and resilient gauge rod which is adapted to extend along a piece of wood or a log that is to be cut across its length, together with a quick attachment fitting for securing said gauge rod to the frame-work of the chain saw, said fitting having a hollow hub which receives one end of the guage rod and also a threaded bore aligned in the hub and adapted to be screwed onto an existing, protruding threaded stud at the chain bar. The fitting has means for securing the guage rod in its hub, and has grippable means which enables it to be manually turned for screwing onto or unscrewing from the stud. The gauge rod is preferably made of a tough, plastic formulation enabling it to be bent, while at the same time it exhibits resiliency so as to spring back if it is accidentally or otherwise deformed. The gauge rod extends laterally from the chain bar and rearward of the cutting zone, whereby it can be disposed along the rear side of the log or limb so that its end will visually indicate to the user the location where the next cut is to be made.

In the accompanying drawings:

FIG. 4 illustrates diagrammatically the various cuts of standardized length which can be made in a tree, by use of the gauging attachment.

FIG. 5 is a perspective view of the chain saw and attachment, cutting through a log, and FIG. 6 is a perspective view of the chain saw and attachment, illustrating another method of use.

Figure 1:
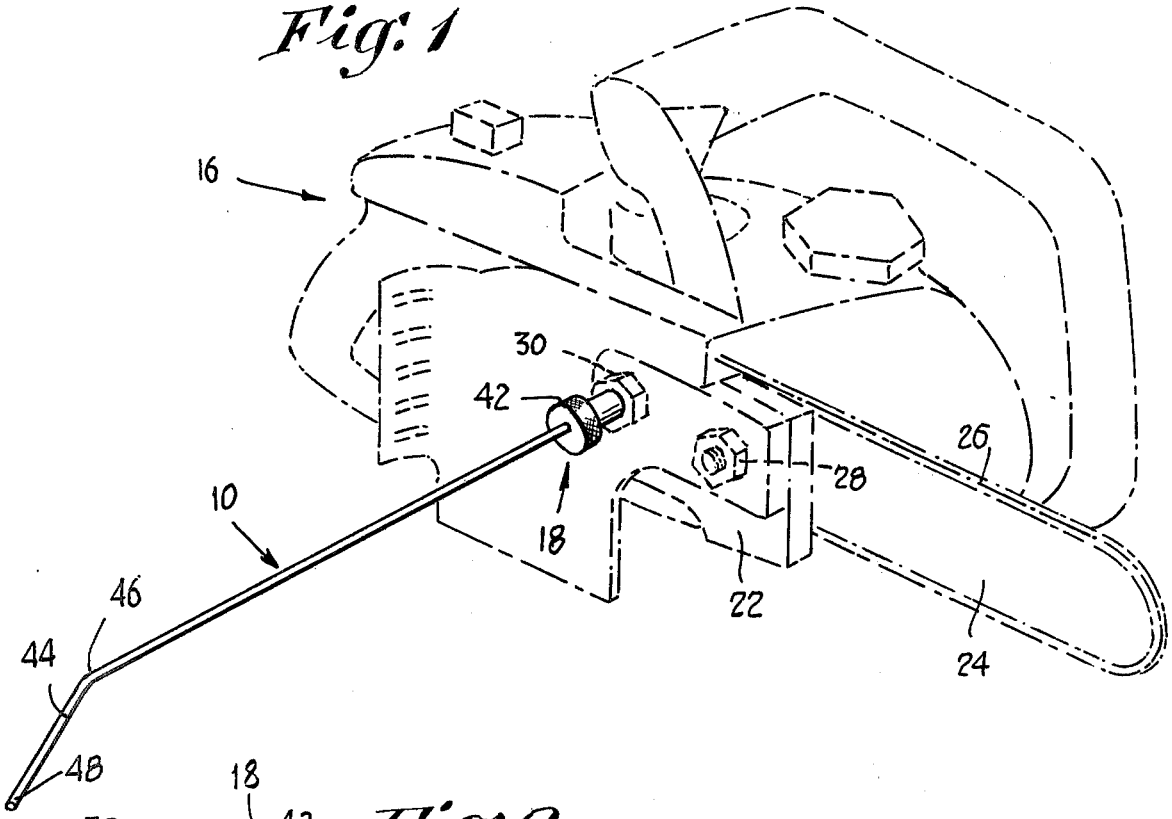
FIG. 1 is a perspective view of the improved gauging attachment of the invention as applied to a chain saw.

As shown, the improved chain saw gauging attachment, which consists of but few parts, comprises an elongate, slender and resilient gauge rod 10 which is adapted to extend along the rear side of a piece of wood or log 12 which is to be cut across its length at the indicated location 14.

For the purpose of enabling quick and easy mounting and dismounting of the gauge rod 10 on and from the chain saw 16, the invention provides a quick-attachment fitting 18 especially adapted to secure the gauge rod to an existing protruding threaded stud 20 of the saw frame. Thus, the gauge rod 10 is, in effect, secured to the framework 22 of the chain saw so as to extend laterally from the chain bar 24 carrying the cutting chain 26, and at the rear of the cutting zone.

Figure 2:
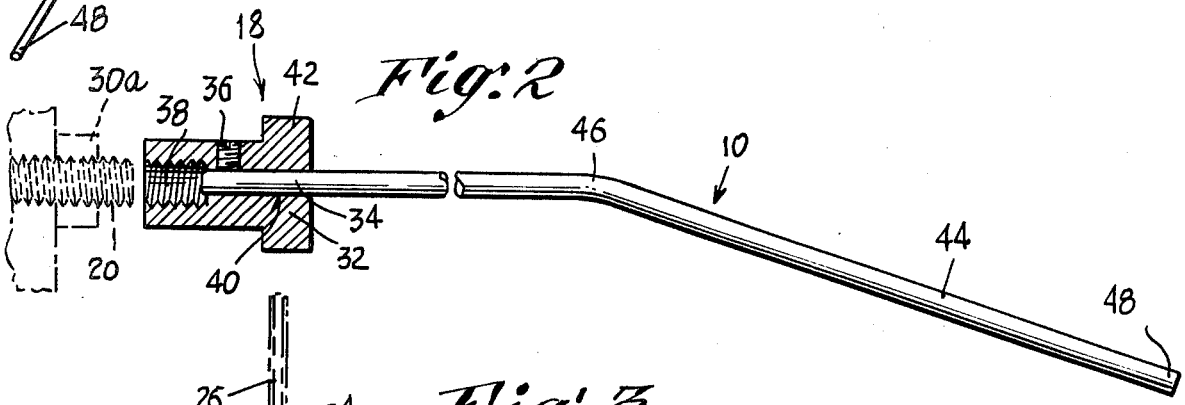
FIG. 2 is a view partly in plan and partly in axial section, of the gauging attachment.
Figure 3:
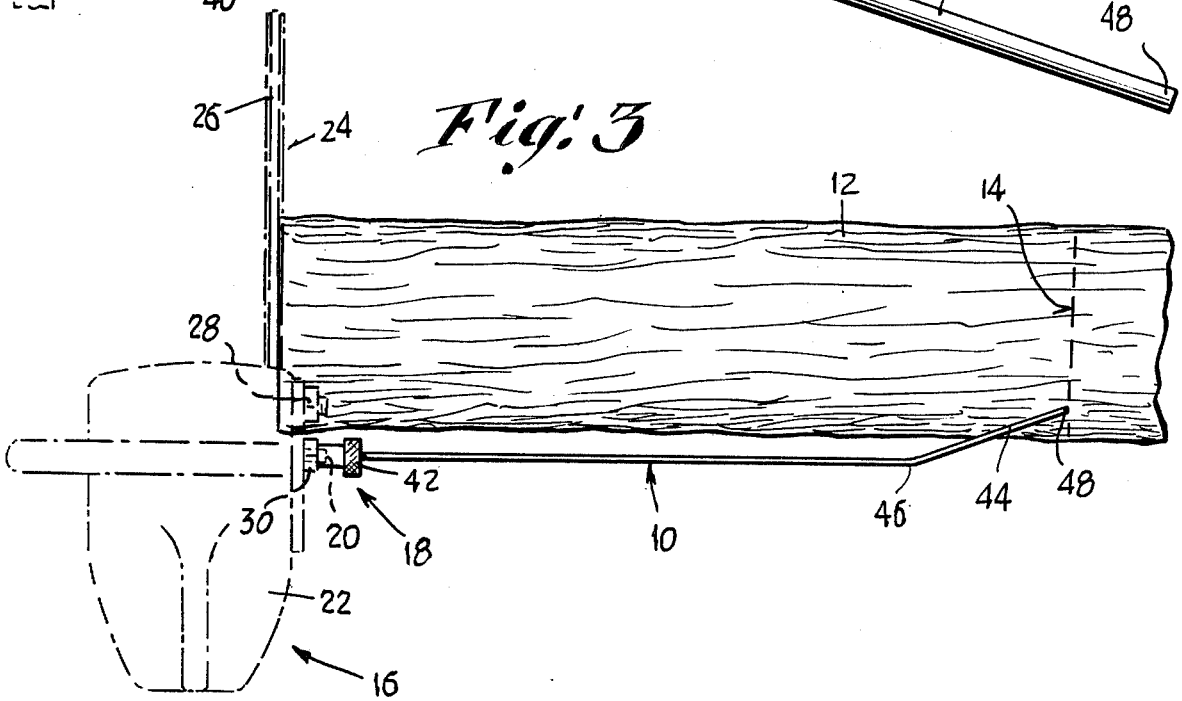
FIG. 3 shows the gauging attachment extending along a log which is to be cut. The associated chain saw is shown in broken outline.

In most instances the chain saw 22 will have two bolts, designated respectively 28 and 30 in FIG. 3, by which the chain bar 24 is adjustably secured in place. These bolts provide protruding, threaded screws or studs, such as the screw 20 illustrated in FIG. 2. The quick-attachment fitting 18 comprises a hollow hub 32 adapted to receive one end portion 34 of the gauge rod 10, and includes a securing means comprising a set screw 36 in the hub, which can be screwed against the rod end 34 to firmly secure the same to the fitting.

The fitting 18 further has a threaded bore 38 disposed in the hub 32 and aligned with a bore 40 of the hub which receives the rod end 34. The threaded bore 38 is adapted to be screwed onto the existing, protruding stud 20 of the chain saw frame, tightly against the nut 30*a* of the bolt.

Further, the invention provides a convenient means for enabling the fitting 18 to be easily and quickly turned for threading it onto or off the stud 20. Such means comprises a flange or rim 42 which is preferably knurled to provide a non-slip surface.

At its remote or free end 44, the gauge rod 10 is provided with a bend 46 to effect an angular off-set whereby the tip 48 of the rod 10 can be readily brought into engagement with the rear side surface of the log which is to be cut, as is clearly indicated in FIGS. 3, 5 and 6.

Different makes of chain saws have protruding studs of different sizes or diameters, and fittings 18 as provided by the invention can be in different colors, each to indicate a particular size or pitch of the thread bore 38, as required by a particular make of chain saw. The remote tip portion 44 of the gauge rod 10 can be given a bright color, such as red or yellow, to facilitate the locating of the place on the log where the next cut is to be made.

The gauge rod can be made of a PVC plastic formulation whereby it is tough and resilient, yet capable of having the bend 46 made in it as desired.

The gauge rod can be cut into shorter lengths as required, in order to produce the desired length of fire wood which is to be obtained for the fireplace or furnace.

Referring to FIG. 3 is will be seen that the attachment is affixed to the saw frame 22 at a location which is well to the rear of the cutting zone, with the gauge rod 10 being adapted to extend along the rear side of the log 12, that is, the side which faces the user. The bent extremity of the end portion 44 of the rod 10, extending angularly forward or away from the user, is adapted to engage the log 12 so as to designate the point at which the next cut is to be made. During the cutting through of the log, any obstruction encountered by the gauge rod 10 will merely cause a flexing of the same, without interfering with or halting the cut. Thus, the gauging attachment is seen to be especially convenient and safe to use, since it provides no impediment to movements of the saw, and follows the cut downward along the rear side of the log, which faces the user.

FIG. 4 illustrates how the gauging rod 10 (normally affixed to the chain saw but which latter is not illustrated in this figure) can be advantageously utilized to cut the limbs and trunk of a tree into uniform lengths.

One general procedure which can be employed when using the invention is illustrated in FIG. 5, wherein the chain saw is located by placement of the rod tip 48 at a previous cut, in order to effect the desired lengths of fire wood. Another method for using the invention is shown in FIG. 6, wherein at the completion of a cut the user glances at the tip 48 of the gauge rod and visualizes a location 14 where the next cut is to be made. This procedure is similar to that shown in FIG. 3.

After a period of use of the gauge rod, the user will be able to arrange the saw cuts in a manner which is most convenient and safe to carry out.

It will now be understood from the foregoing that I have provided a novel and improved chain saw gauging attachment which is especially simple and inexpensive in its construction, whereby the fabricating cost is held to a minimum. But few parts are needed, and these can be economically produced by high production processes. The attachment can be easily and quickly applied to and removed from the chain saw, is rugged and durable in use, and will withstand either intentional or accidential deformation to a considerable degree without breakage. No modification is normally required of the chain saw, as a rule. In some instances, a slimmer nut 30*a* can be utilized in place of the existing nut, so as to secure additional threads on the protruding stud 20.

Variations and modifications are possible without departing from the spirit of the invention.

I claim:

1. A length-of-cut gauging attachment for chain saws, comprising in combination:

(a) an elongate, slender gauge rod adapted to extend along a piece of wood or log which is to be cut across its length, (b) a quick-attachment fitting for securing said gauge rod to the frame work of the chain saw, (c) said fitting having a hollow hub adapted to receive one end of the gauge rod, and having means engageable with said rod end to firmly secure the same to the fitting, (d) said fitting having a threaded bore disposed substantially in alignment with the hub, said threaded bore being adapted to be screwed onto an existing protruding threaded stud of the chain saw frame, and (e) said fitting having means enabling it to be manually turned and screwed tightly on said stud whereby the gauge rod extends laterally from the saw frame and chain track thereof, thus enabling a user when making a cut with the saw to dispose the gauge rod along the work for the purpose of sighting the place at which the next cut is to be made.

2. A chain saw gauging attachment as claimed in claim 1, wherein:

(a) said guage rod is constituted of a material enabling it to be bent at its free end, so as to extend transversely of the length of the work piece, whereby a specific designation can be had of the location on the work piece where the next saw cut is to be made.

3. A chain saw gauging attachment as claimed in claim 1, wherein:

(a) the gauge rod is constituted of a material which enables its end portions to be readily cut, so as to shorten the rod to a desired length.

4. A chain saw gauging attachment as claimed in claim 2, wherein:

(a) said gauge rod is constituted of polyvinylchloride plastic material.

5. A chain saw gauging attachment as claimed in claim 1, wherein:

(a) said means enabling the fitting to be tightly screwed onto the stud comprises a knurled peripheral portion of the fitting.

6. A chain saw gauging attachment as claimed in claim 1, wherein:

(a) said gauge rod fitting is adapted for attachment to the chain saw frame at a location to the rear of the cutting zone of the saw, (b) said gauge rod at its free extremity being bent forwardly to enable the extremity to engage the rear side of the work to be cut while the gauge rod is spaced therefrom.

* * * * *